United States Patent [19]

Neumann et al.

[11] 4,063,320

[45] Dec. 20, 1977

[54] INFLATABLE BOAT

[75] Inventors: Henning Neumann, Germering; Fritz Federer, Turkenfeld, both of Germany

[73] Assignee: Metzeler Kautschuk AG, Munich, Germany

[21] Appl. No.: 706,212

[22] Filed: July 19, 1976

[30] Foreign Application Priority Data

July 21, 1975 Germany ..... 2532542

[51] Int. Cl.[2] ..... B63B 7/08

[52] U.S. Cl. ..... 9/2 A; 115/24.1

[58] Field of Search ..... 9/2 A; 114/144 R, 152, 114/61; 115/24.1, 24.4, 24.5, 24.6

[56] References Cited

U.S. PATENT DOCUMENTS

| | | | |
|---|---|---|---|
| 2,259 | 9/1841 | Nichols | 115/24.1 |
| D. 154,774 | 8/1949 | Harris et al. | 9/2 A |
| 2,040,616 | 5/1936 | Mapes | 9/2 A |
| 2,550,625 | 4/1951 | Vick | 115/24.6 |
| 2,778,036 | 1/1957 | Bergman | 115/24.6 |
| 2,891,260 | 6/1959 | Wright | 9/2 A |
| 2,949,616 | 8/1960 | Desanges | 9/2 A |
| 2,999,253 | 9/1961 | Lewis | 9/2 A |
| 3,785,317 | 1/1974 | Currey | 9/2 A |
| 3,885,512 | 5/1975 | Marcil | 114/61 |

FOREIGN PATENT DOCUMENTS

| | | | |
|---|---|---|---|
| 248,905 | 8/1966 | Austria | 9/2 A |
| 446,903 | 10/1925 | Germany | 9/2 A |

*Primary Examiner*—Trygve M. Blix
*Assistant Examiner*—Stuart M. Goldstein
*Attorney, Agent, or Firm*—Michael J. Striker

[57] ABSTRACT

An inflatable boat includes a buoyant body having a pair of elongated lateral portions which are arcuately raised at both the bow region and the stern region thereof, a stern bulkhead connected to the lateral portions and extending between them, and a bottom which is water-tightly connected to the lateral portions and to the stern bulkhead and defines a compartment therewith. The lateral portions are constituted by inflatable tubular elements which are interconnected at the bow region of the inflatable boat by a rigid connecting element. The stern regions of the tubular elements extend beyond the stern bulkhead and arcuately converge toward one another in the rearward direction, being spaced from one another by a distance which at least corresponds to the maximum diameter of the tubular elements. A support element is mounted on the stern regions, and a rudder is mounted on the support element with freedom of movement relative thereto. A cover may be attached to the stern bulkhead and to the stern regions of the tubular elements to form an additional compartment therewith.

18 Claims, 5 Drawing Figures

INFLATABLE BOAT

BACKGROUND OF THE INVENTION

The present invention relates to an inflatable boat, particularly for use on flowing water-courses. More particularly, the present invention relates to a raft-shaped inflatable boat.

There are already known various types of inflatable boats, both for use on stationary and flowing bodies of water. Such inflatable boats include, among others, canoes, kayaks, lifeboats and rafts. The present invention is particularly concerned with raft-shaped inflatable boats for use on flowing water-courses, such as rivers, and particularly for use in rapids.

The conventional raft-shaped inflatable boats include pairs of inflatable lateral tubular elements which are interconnected with one another at least in the bow region of the inflatable boat either directly, with the possibility of being of one piece, or indirectly by means of an interposed, usually rigid, connecting element situated at the bow region of the inflatable boat. In addition thereto, such conventional inflatable boats have a bottom which is water-tightly connected to the tubular elements and which may also be inflatable, and possibly also a stern bulkhead which extends transversely of the tubular elements and upwardly from the bottom to form a compartment therewith.

An inflatable raft of this type is disclosed in a published German application DT-AS No. 1,103,800 in which the stern regions of the lateral tubular elements extend rearwardly beyond the stern bulkhead. The stern bulkhead is equipped with a rigid support element which serves the purpose of mounting a propelling motor thereon. This conventional inflatable boat is very wide in the stern region thereof in that the stern regions of the lateral tubular elements which extend rearwardly beyond the stern bulkhead are straight so that, when such boat is used on rough bodies of water, such as in rapids, there is the danger that waves may overflow the stern bulkhead and fill the compartment of the boat.

Another conventional inflatable boat of this type is disclosed in the German published patent application DT-OS No. 2,051,835 in which, when considered in top plan view, the buoyant body of the boat is so configurated as to resemble a letter A. In order to achieve this, the lateral portions in form of inflatable tubular elements are connected with one another at the bow region of the boat, while the lateral portions gradually diverge from one another in direction from the bow portion rearwardly and their ends are situated rearwardly of the stern bulkhead. In this conventional inflatable boat, the stern end regions of the lateral portions constitute the lowest points of the boat. This inflatable boat is constructed as special hydroplaning boat which has been designed for use with a powerful motor-driven en propelling arrangement. This type of an inflatable boat is not suited for use on flowing streams, especially since it cannot be reliably controlled inasmuch as its directional stability is extremely low when not motor-driven. An additional disadvantage of this inflatable boat is to be seen in that the stern bulkhead is easily overflown by waves when the body of water on which the inflatable boat floats is rough and the progress of the boat over the surface of such body of water is slow. So, for instance when this boat is rotated through 180 degrees or so about its vertical axis, such as during the travel on a river having a swift current, waves or eddies, the height of the stern bulkhead will be insufficient for preventing the waves which move towards the stern bulkhead under these circumstances, from flowing over the stern bulkhead and from entering the compartment of the boat.

The German published patent application DT-OS No. 2,051,834 discloses an inflatable boat having a rigid insertable bottom. The lateral tubular elements of this inflatable boat are arcuately raised in the bow region of the boat and are connected to one another by means of rigid connecting elements. On the other hand, the stern regions of the lateral tubular elements extend rearwardly beyond the stern bulkhead in a funnel-shaped fashion. The smooth insertable bottom, the specially arcuately raised configuration of the bow, and the rearwardly extending stern regions of the lateral elements facilitate the gliding or hydroplaning of the inflatable boat. Similarly to the immediately above discussed conventional boat, this inflatable boat is not suited for use on rivers or similar streams, especially on shoal water. For such a use, the configuration of the bottom of this boat particularly disadvantageous, inasmuch as the rigid and flat inflatable boat bottom is only covered by a strongly tensioned skin, which is tensioned by the inflation of the lateral elements and the forces resulting therefrom.

It will be appreciated that this bottom is extremely susceptible to perforation by sharp-pointed stones or other obstructions which are likely to come into contact with the inflatable boat from below. In addition thereto, the low and wide stern bulkhead is easily overflown by waves, and the stern region of the boat is easily laterally diverted.

For the above-mentioned reasons, neither of the above-discussed prior-art inflatable boats is suited for use on flowing streams, and particularly in rapids.

SUMMARY OF THE INVENTION

It is a general object of the present invention to avoid the disadvantages of the prior art.

More particularly, it is an object of the present invention to construct an inflatable boat which is suited for use on flowing streams and particularly in rapids.

A further object of the present invention is to device a raft-shaped inflatable boat which is simple in construction and reliable in operation.

A concomitant object of the present invention is to provide an inflatable boat which can be easily and reliably controlled as to its direction of travel regardless of adverse conditions.

Yet another object of the present invention is to provide an inflatable boat which is influenced to a minimum extent by swift currents, rough water, eddies and obstructions along the course of travel of the boat.

A still another object of the present invention is to device an inflatable boat which is compact, safe and easy to transport.

In pursuance of these objects and others which will become apparent hereinafter, one feature of the present invention resides, briefly stated, in an inflatable boat, particularly for use on streams, which comprises, in combination, a buoyant body having a bow portion and a pair of elongated lateral portions each of which has a stern region which is arcuately raised with respect to the remainder of the respective lateral portions; a stern bulkhead connected to and extending between the lateral portions intermediate the stern regions thereof and the above-mentioned remainders thereof; and a bottom which has a marginal portion that is water-tightly connected to the bow portions, the abovementioned remainders of the lateral portions, and the stern bulkhead and which defines a compartment therewith. Preferably the bow portion is also arcuately raised relative to the remainder of the lateral portions, and the stern regions of the lateral portions are raised to at least the same level as the bow portion.

In a currently preferred embodiment of the present invention, the buoyant body includes a pair of discrete inflatable tubular elements which extend longitudinally of the boat and form the above-mentioned lateral portions, and means for interconnecting the tubular elements at the above-mentioned boat portion, the interconnecting means including a rigid connecting element which is connected to the bow regions of the tubular elemens. Advantageously, the stern regions of the lateral portions arcuately converge toward one another in direction toward respective end zones thereof. As a result of the fact that the stern regions of the lateral portions are raised, the inflatable boat acquires, so to say, a second bow so that, even if the boat is moved by the current in a sideways direction or even with its bow facing rearwardly, the boat can still be used and maneuvered in this position without running the danger that the waves will overflow the stern bulkhead and fill the compartment of the boat.

The stern regions, which are extremely extended in the rearward direction of the boat beyond the stern bulkhead, increase the buoyancy of the boat in this region to a considerable extent, and simultaneously therewith, they contribute, as a result of the arcuate raising, to the controllability of the boat inasmuch as the arcuate stern regions of the lateral tubular elements can, without damage thereto, come into contact with obstructions, thus permitting the boat to overcome such obstructions and proceed further and to be thus maneuverable even when trailing with its stern region facing in the direction of travel.

According to a further concept of the present invention, the stern regions of the lateral portions extend rearwardly beyond the stern bulkhead to a distance which at least corresponds to the maximum transverse dimension of the above-mentioned compartment, but which can be as great as the maximum transverse dimension of the buoyant body. In this embodiment, the stern regions of the lateral portions may arcuately converge toward one another in direction toward the respective end zones thereof, the end zones being spaced from one another by a distance which at least corresponds to the maximum diameter of the lateral portions. Furthermore, the inflatable boat of the present invention may be equipped with a support element which is mounted on the stern regions of the lateral portions and extends between the end zones thereof. The boat may be further equipped with a rudder, in which event the rudder may be mounted on the support element with freedom of movement relative thereto, preferably in a manner resembling an universal joint. When this is the case, a rudder having a long stem can be clampingly retained in the mounting means, which can be constructed as a mounting lug having an annular member mounted on the support element, and a plurality of clamping screws mounted on the annular member and contacting the stem of the rudder, so that the rudder can then be used for controlling the direction of travel of the boat in a manner resembling the control of a raft. As a result of the rearward extension of the stern regions of the lateral tubular elements, the fulcrum of the rudder is considerably transferred toward the rear of the inflatable boat so that the lever action of such a very long rudder remains very advantageous. In other words, the handling of the rudder does not require any excessive actuation forces. In addition thereto, inasmuch as the end zones of the stern regions of the lateral tubular elements, on which the support element is mounted, are spaced from one another by a considerable distance, the rudder can be displaced through a significant angle without interfering with the end zones of the stern regions of the lateral tubular elements. Thus, the rudder is freely movable within its range of operation.

As a result of the arcuate raising of the stern regions of the lateral tubular elements up to or beyond the level to which the bow region of the inflatable is arcuately raised, the maneuverability of the inflatable boat is improved no matter which of the boat ends faces in the direction of travel of the inflatable boat.

In a currently preferred, advantageous, embodiment of the present invention, the mounting lug is mounted on the support element for displacement transversely of the inflatable boat, that is closer or farther away from a respective one of the end zones of the stern regions of the inflatable elements. Preferably, the mounting lug can be arrested in any transversely displaced position thereof so that the fulcrum for the rudder, which this mounting lug constitutes, can be located in any advantageous transverse position of the boat, depending on the position at which the user of the boat intends to stand or sit during the use of the inflatable boat. The universal-joint movability of the mounting lug is very important inasmuch as the rudder can then be immersed to any desired depth underneath the surface of the body of water over which the inflatable boat travels or, conversely, the rudder can be lifted out of the water to any desired extent, which is a very important consideration particularly when the boat travels over obstructions which may be present in the path of travel of the boat or along said path.

However, it is also possible to use a simplified construction of the mounting means. So, for instance, the mounting lug may be bifurcated so as to resemble an oar lug which is either opened in the upward direction, or closed by a bracket which straddles the distance between the arms of the bifurcated mounting lug. In this event, the mounting lug may be supported in a bore provided in the support element for pivoting therein.

For the assembling, disassembling and transportation of the inflatable boat, particularly when it is desired that the collapsed boat assumes as little space as possible, it is advantageous and proposed according to the present invention to construct the support element of a plurality of tubular members which are received one within the other in a telescopic manner. Then, the support element may be supported on the end zones of the stern regions by means of mounting brackets. Under these circumstances, the support element can be easily detached from the tubular lateral elements and telescopically collapse so as not to take an excessive space.

The inflatable boat of the present invention preferably has an inflatable bottom, which not only increases the buoyancy of the boat, but also lessens the danger of damage or perforation of the bottom in view of the fact that such inflatable bottom is more flexible and wear and damage resistant than rigid bottoms. In order to improve the loadability of the bottom and to assure that users of the boat can walk over the bottom without encountering difficulty, despite the inherent flexibility of such bottoms, it is further proposed to superimpose a collapsible grating bottom upon the inflatable bottom in the compartment inbetween the lateral tubular elements.

According to a further concept of the present invention, at least the tubular elements, but preferably also the inflatable bottom and the stern bulkhead are made of flexible material, such as rubber, rubber-coated synthetic plastic fabric, polyvinylchloride or fabric-reinforced polyvinylchoride.

The novel features which are considered as characteristic for the invention are set forth in particular in the appended claims. The invention itself, however, both as to its construction and its method of operation, together with additional objects and advantages thereof, will be best understood from the following description of specific embodiments when read in connection with the accompanying drawings.

DETAILED DISCUSSION OF THE PREFERRED EMBODIMENTS

Figure 1:
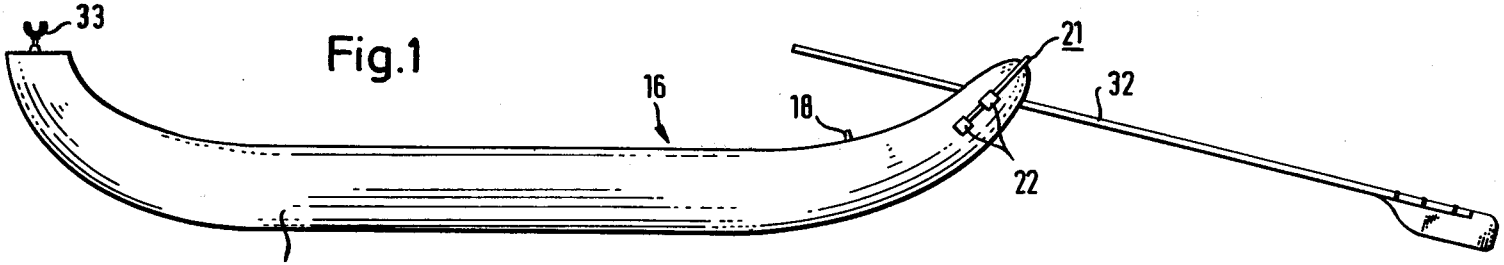
FIG. 1 is a side elevational view of an inflatable boat of the present invention.
Figure 2:
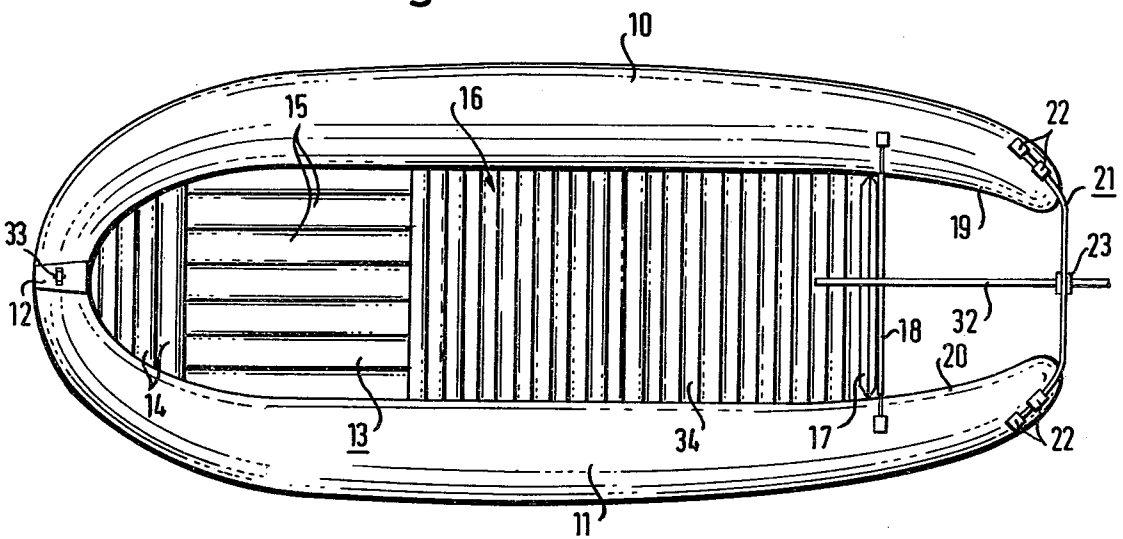
FIG. 2 is a top plan view of the boat of FIG. 1.
Figure 5:
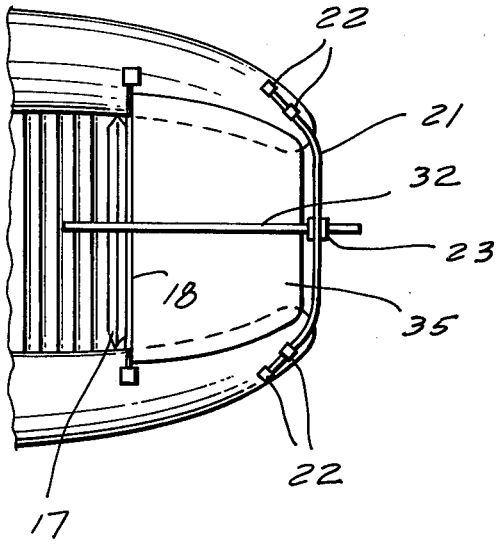
FIG. 5 shows a top plan view of the aft end of the boat.

Referring now to the drawings and first to FIGS. 1 and 2 thereof, it may be seen that the inflatable boat of the present invention, which has a configuration resembling a raft, includes two lateral inflatable tubular elements 10 and 11 which are connected with one another, in the bow region of the boat, by means of a rigid connecting element 12. The bow regions of the elements 10 and 11 are outwardly raised in the upward direction when considered in the position of the boat during its use. The tubular elements 10 and 11 are connected with one another, in their lower regions, by means of an inflatable boat bottom 13, which has transversely extending inflatable ribs 14 only in the bow region of the bottom 13, while it has elongated inflatable ribs 15 extending parallel to the longitudinal axis of the inflatable boat over the remainder of the boat bottom 13. The tubular lateral elements 10 and 11 and the boat 13 together bound a compartment 16 which is closed in the stern region of the inflatable boat by means of a stern bulkhead 17 which, in the illustrated embodiment, is also inflatable. Both the boat bottom 13 and the stern bulkhead are water-tightly connected to the lateral tubular elements 10 and 11. The stern bulkhead 17, when so desired, can be reinforced and rigidified by a solid stern board 18 which is also connected to the lateral tubular elements 10 and 11 in the upper regions thereof and is so configurated that a propelling arrangement including a driving motor can be supported thereon. Such a propelling arrangement may be of an entirely conventional construction and thus been omitted from the drawing.

The lateral tubular elements 10 and 11 have respective stern regions 19 and 20 which extend rearwardly and beyond the stern bulkhead 17 by a distance which may be anywhere between approximately the transverse dimension of the compartment 16 and the maximum transverse dimension of the boat. The end zones of the stern regions 19 and 20 forming parts of the lateral tubular elements 10 and 11 can also be reinforced by an additional stern board which has not been illustrated because it is of a conventional construction.

The stern regions 19 and 20 of the lateral tubular elements 10 and 11 are arcuately raised with respect to the remainder of the respective lateral tubular elements 10 and 11, their curvature being greater than the curvature of the bow region of the inflatable boat. Simultaneously, the stern regions 19 and 20 of the lateral tubular elements 10 and 11 are curved inwardly when considered in the rearward direction of the boat so that they converge toward one another. The end zones of the stern regions 19 and 20 of the lateral tubular elements 10 and 11 thus face one another at an elevation which approximately corresponds to the elevation of the connecting element 12, the distance between the end zones of the stern regions 19 and 20 of the lateral tubular elements 10 and 11 approximately corresponding to the greatest diameter of the respective tubular lateral elements 10 and 11.

A rigid support element 21 spans the distance between the stern regions 19 and 20 of the lateral tubular elements 10 and 11, such support elements 21 being fixed to the stern regions 19 and 20 of the lateral tubular elements 10 and 11 by means of holding elements 22 in form of brackets or the like of a conventional construction.

The ends of the support elements 21 are so accommodated in the respective holding elements 22 that the support element 21 reinforces and rigidifies the stern region of the inflatable boat. In addition thereto, the support element 21 serves the purpose of mounting a clamping lug, designated in toto with reference numeral 23, thereon. The clamping lug 23, in turn, serves the purpose of holding an extremely long rudder 32 the position of which can be controlled from the compartment 16 of the inflatable boat.

Figure 3:
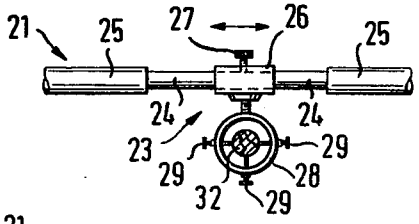
FIG. 3 is a detail view illustrating one embodiment of the suspension of a boat rudder in the boat of FIG. 1.

One possible embodiment of the mounting arrangement in form of a mounting lug is illustrated in FIG. 3 in more detail, in which Figure it may be seen that the support element 21 of this embodiment includes tubular members 24 and 25 which are telescopically received within one another. The tubular members 24 and 25 are telescopically displaceable relative to one another, so that the support element 21 can be disassembled or telescopically collapsed when the inflatable boat is to be transported from one location to another. An additional advantage of this telescoping arrangement is that the support element 21 can be easily assembled and the length thereof can be adjusted to the instantaneous spacing of the stern regions 19 and 20 of the lateral tubular elements 10 and 11.

The clamping lug 23 is mounted in the central region of the support element 21, which clamping lug is supported on the support element 21 by means of a sleeve 26 so as to be displaceable in the transverse direction of the boat closer to and farther away from the respective stern regions 19 and 20 of the lateral tubular elements 10 and 11. The sleeve 26 can then be arrested in any desired position by means of a set screw 27. The clamping lug 23 can be arranged underneath, as well as upwardly of, the support element 21. The tubular members 24 and 25 of the support element 21 can be rotated relative to one another so that any angular position of the very long rudder 32 relative to the imaginary longitudinal axis of the boat can be obtained.

The clamping lug 23 includes a clamping ring 28 arranged underneath the sleeve 26 for rotation relative thereto, and the stem of the rudder 32 is accommodated in the opening of the clamping ring 28, and if so desired, arrested therein by means of set screws 29 so as to avoid the possibility that the rudder 32 could slide out of the opening of the ring 28 or could assume an undesirable position relative thereto. While three set screws 29 have been illustrated, distributed along the circumference to the ring 28 at 90 degrees apart, it will be apparent that any other number or distribution of such set screws 29 is conceivable.

Figure 4:
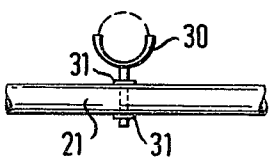
FIG. 4 illustrates a simplified suspension for the rudder of the boat of FIG. 1.

FIG. 4 illustrates a simplified embodiment of the fulcrum for the rudder 32, in which a generally Y-shaped clamping lug 23 resembling in appearance an oar lock is supported on the support element 21 and held therein by corresponding conventional connecting elements 31. As illustrated in broken lines in FIG. 4, the clamping lug 23 can be circumferentially completed by a conventional bracket connected to the arms of the bifurcated oarlock 30.

The inflatable boat which is constructed and equipped in the above-described manner, is excellently suited for use on flowing water-courses, such as rivers, swift flowing navigable brooks or in rapids. On the other hand, this inflatable boat can also be used as a motor boat, in which event, a propelling arrangement having a motor is mounted on the stern board 18. The direction of travel of the inflatable boat is preferably controlled, and the boat is maneuvered, by means of the rudder 32 which extends a considerable distance rearwardly behind the inflatable boat proper. In the event that the inflatable boat is propelled by means of oars or paddles, it is assured that, even when the inflatable boat moves very slowly or over disturbed water surface, it is possible to conduct any desirable maneuver of the boat without encountering any difficulties by conducting forceful and great movements of the rudder 32, due to the fact that the rudder 32 has a very advantageous and long actuating arm and a long actuated arm. For use in very critical conditions, a further rudder lug 33, also in form of an oar lock may be provided at the bow region of the boat, particularly on the connecting element 12, in which event an additional auxiliary rudder may be supported in such additional lug 33 and used for improving the maneuvers conducted by the inflatable boat under such circumstances.

It is also possible, if so desired, to let the inflatable boat travel with its stern region ahead, in which event the steering rudder 32 is supported in the support lug 33. In this event, the above-discussed special construction and configuration of the rear or stern region of the inflatable boat assures that the inflatable boat can always be excellently controlled.

When it is not desired to use any propelling arrangement of the motor-driven type for advancing the inflatable boat, the space behind the stern bulkhead 18 can be spanned by an additional plate or cover 35 to that an additional compartment is obtained which may serve for storage purposes. Even in this situation, the steering rudder 32, which is located above the plane assumed by the plate or cover 35, is not interfered with in its movement. The cover may be attached to the stern bulkhead 18 and to the lateral tubular elements 10 and 11 by conventional connecting means.

For reasons of stability, it may also be desirable to directly interconnect the stern regions 19 and 20 of the lateral tubular elements 10 and 11 with one another in the stern region of the boat, possibly utilizing a rigid connecting element for this purpose, in which case the clamping lug 23 for the steering rudder 32 is mounted on or at this connecting element.

Furthermore, the lateral tubular elements 10 and 11 can be provided at their outer circumferential surfaces with ropes supported in brackets or the like, which render it possible to enter the boat compartment 16 also while the boat is floating over a body of water and the person intending to enter the compartment 16 is swimming in the body of water. An advantage obtained by these ropes is that the inflated boat can be easily transported by the occupants of the boat from one location to another, such as to avoid or circumvent non-passable rapids or other water passages. In order to improve the safety, the bottom 13 of the boat may be provided with feet loops, in which event the users of this inflatable boat, when inserting their feet into such loops, find excellent support in the boat compartment 16 and can concentrate on maneuvering of the boat.

As illustrated in FIG. 2, the bottom 13 of the boat is covered by a grating floor 34 which floor 34 can be removed from the compartment 16 and the space assumed thereby can be minimized by collapsing such floor 34.

The tubular elements 11, but preferably also the bottom 13 and the stern bulkhead 17 are made of a wear-resistant resilient material, such as rubber, rubberized synthetic plastic filament fabric, polyvinylchloride or fabric-reinforced polyvinylchloride.

It will be understood that each of the elements described above, or two or more together, may also find a useful application in other types of constructions differing from the types described above.

While the invention has been illustrated and described as embodied in an inflatable raft, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims:

1. An inflatable boat, particularly for use on streams, comprising in combination an inflatable bottom elongated in a first direction and having a bow portion and a stern portion spaced from each other in said first direction; a stern bulkhead located aft of said stern portion of said bottom and extending in a second direction substantially transverse to said first direction; two lateral elements extending substantially in said first direction and spaced from each other in said second direction, said lateral elements being water-tightly connected to said bottom and said bulkhead and defining a compartment therewith, said lateral elements each having a first portion adjacent said bow portion of said bottom, and a second portion adjacent said stern portion of said bottom and spaced from said first portion in said first direction, said second portions of said lateral elements extending rearwardly beyond said stern bulkhead in said first direction, the first and second portions of one of said lateral elements substantially arcuately and gradually approaching towards the first and the second portions of the other lateral element, respectively, and the first and second portions of both lateral elements simultaneously being upwardly raised relative to the remainder of said lateral elements to substantially the same height; and two rigid connecting elements each connecting said first and second portions of one of said lateral elements to said first and said second portions of the other lateral element, respectively, substantially at the respective end sections thereof.

2. A combination as defined in claim 1, wherein said lateral elements are discrete inflatable tubular elements.

3. A combination as defined in claim 1, wherein said second portions of said lateral elements extend rearwardly beyond said stern bulkhead to a distance which at least corresponds to the maximum transverse dimension of said compartment.

4. A combination as defined in claim 3, wherein said distance corresponds to the maximum transverse dimension of said boat.

5. A combination as defined in claim 1; and further comprising a grating positioned at least over a portion of said bottom.

6. A combination as defined in claim 1; and further comprising a support element mounted on said second portions of said lateral elements and extending between the end sections thereof.

7. A combination as defined in claim 6; and further comprising a rudder; and means for mounting said rudder on said support element with freedom of movement relative thereto.

8. A combination as defined in claim 7, wherein said mounting means includes an mounting lug.

9. A combination as defined in claim 8, wherein said mounting lug includes an annular member mounted on said support element, and a plurality of clamping screws mounted on said annular member and contacting a portion of said rudder to thereby clamp the same in said annular member.

10. A combination as defined in claim 8, wherein said mounting lug includes a bifurcated member mounted on said support element for pivoting relative thereto in a manner of an oar lock.

11. A combination as defined in claim 10, wherein said mounting lug further includes a connecting bracket mounted on the arms of said bifurcated member and spanning the distance between the same.

12. A combination as defined in claim 8, wherein said support element has an elongated portion extending in the transverse direction of the boat; and wherein said mounting means further includes an adjusting member which mounts said mounting lug on said elongated portion for adjustment lengthwise thereof.

13. A combination as defined in claim 6, wherein said support element includes a plurality of tubular members telescopically received within one another.

14. A combination as defined in claim 6, and further comprising holding brackets which mount said support element on said stern regions.

15. A combination as defined in claim 1, and further comprising a cover, and means for attaching the cover to said stern bulkhead and to said stern regions of said lateral portions to form an additional compartment therewith.

16. A combination as defined in claim 1, wherein the material of at least said lateral portions of said buoyant body is selected from the group consisting of rubber, rubber-coated synthetic plastic fabric, polyvinylchloride and fabric-reinforced polyvinylchloride.

17. A combination as defined in claim 1, wherein the end sections of the first and the second portions of one of said lateral elements are spaced from the respective end sections of the first and the second portions of the other lateral element in said second direction, said connecting elements each connecting the respective end sections of said first and said second portions of said lateral element with each other and bridging the distance therebetween.

18. A combination as defined in claim 1, wherein said end sections of said second end portions of said lateral elements are spaced from one another by a distance which at least corresponds to the maximum diameter of said lateral elements.

* * * * *